US008025241B2

(12) United States Patent
Buda et al.

(10) Patent No.: US 8,025,241 B2
(45) Date of Patent: Sep. 27, 2011

(54) HOLLOW SLEEPER

(75) Inventors: Roland Buda, Radolfzell (DE); Frank Meyer, Stockach (DE)

(73) Assignee: Schwihag AG, Taegerwilen (CH)

( * ) Notice: Subject to any disclaimer, the term of this patent is extended or adjusted under 35 U.S.C. 154(b) by 233 days.

(21) Appl. No.: 12/296,733

(22) PCT Filed: May 2, 2007

(86) PCT No.: PCT/EP2007/003860

§ 371 (c)(1),
(2), (4) Date: Oct. 10, 2008

(87) PCT Pub. No.: WO2007/128473

PCT Pub. Date: Nov. 15, 2007

(65) Prior Publication Data

US 2009/0121036 A1 May 14, 2009

(30) Foreign Application Priority Data

May 10, 2006 (DE) ..... 10 2006 021 683

(51) Int. Cl.
*E01B 9/14* (2006.01)

(52) U.S. Cl. ..... 238/29; 238/54

(58) Field of Classification Search ..... 238/29, 238/30, 54, 62, 82
See application file for complete search history.

(56) References Cited

U.S. PATENT DOCUMENTS

| | | | | |
|---|---|---|---|---|
| 1,110,198 | A * | 9/1914 | Green | 238/54 |
| 1,259,756 | A * | 3/1918 | Lucas | 238/30 |
| 1,358,536 | A * | 11/1920 | Fisk | 238/62 |
| 1,383,954 | A * | 7/1921 | Jones | 238/62 |
| 5,540,382 | A * | 7/1996 | Scheller | 238/2 |
| 5,562,267 | A | 10/1996 | Heim | 246/415 |
| 6,158,698 | A * | 12/2000 | Click et al. | 246/449 |
| 7,070,152 | B2 * | 7/2006 | Schwiede et al. | 246/476 |

* cited by examiner

*Primary Examiner* — Joe Morano, IV
*Assistant Examiner* — R. J. McCarry, Jr.
(74) *Attorney, Agent, or Firm* — Andrew Wilford

(57) ABSTRACT

In the case of a hollow sleeper (1) for adjusting devices of switch blades of railway points, movable common crossings or cable crossings in any desired sections of track and points, formed as an upwardly open hollow sleeper profile with a planar sleeper underside (2), for fitting in a track skeleton, wherein the cross-sectional width and height are made to match a normal concrete, wooden or steel sleeper, the positional stability on ballast can be improved if the sleeper underside (2) of the hollow sleeper (1) is formed with at least one sunken, downwardly open chamber (5).

6 Claims, 2 Drawing Sheets

HOLLOW SLEEPER

CROSS REFERENCE TO RELATED APPLICATIONS

This application is the US national phase of PCT application PCT/EP2007/003860, filed 2 May 2007, published 15 Nov. 2007 as WO 2007/128473, and claiming the priority of German patent application 102006021683.0 itself filed 10 May 2006, whose entire disclosures are herewith incorporated by reference.

FIELD OF THE INVENTION

The invention relates to a hollow cast sleeper for actuating elements of switch blades, movable frogs, or cable crossings in any track and switch sections, the sleeper being designed as an upwardly open hollow cast sleeper profile with a planar tie lower face or floor for installation in a track bed, the cross-sectional width and height being matched to a standard concrete, wooden, or steel tie.

BACKGROUND OF THE INVENTION

A hollow or transverse-hollow cast sleeper of this type has been disclosed in DE 43 15 200 [U.S. Pat. No. 5,562,267]. Hollow cast sleepers are employed in railroad track systems, in particular, to accommodate the switch actuator (closure-type hollow cast sleeper) or for cable crossings (cable-type hollow cast sleepers), and are installed at the same site as existing concrete, wood, or steel ties, or as replacements for these ties.

Known hollow cast sleepers or box-type hollow cast sleepers in the form of close cast sleepers are preferably fabricated from folded sheet steel bent into as U-sections, or mace by casting, and ensure that the hollow cast sleeper sections can be tamped in as well as the adjacent concrete, wooden, or steel ties.

However, in order to achieve the same or improved stable positioning—by which is meant the elasticity in the tie bedding as well as the smallest possible transverse and longitudinal displacement of the hollow cast sleeper—as is obtained with the corresponding, for example, replaced concreted, wooden, or steel sleeper, it is often necessary to level the contact area between the lower floor surface or the so-called footing of the hollow cast sleeper and the ballast of the track section. As a rule, this leveling or fitting is effected only with standard concrete sleepers by means of elastic or semi-elastic footings for the lower floor surface.

In the case of concrete sleepers, the sleeper footings in the form of bearing plates are generally attached by adhesive, or, for example, cast on as an integral component.

Due to the operational load on standard sleepers and due to the tamping of adjacent hollow cast sleepers with ballast, the circumferential edge zone of the attached elastic bearing plate tends to peal off or tear off, this last effect being caused by transverse and longitudinal movements of the sleeper in the ballast bed.

The entire surface of the bearing plates is attached to the lower face of the sleeper or to the lower sleeper floor. The plates are thus generally fabricated in one-piece form in a size corresponding to the entire surface of the lower face of the sleeper, a procedure that results in additional costs in the fabrication process.

Since generally only one continuous bearing plate or sleeper footing is used per standard sleeper, it is possible only to a limited degree to achieve a balanced distribution of elasticity. Nevertheless, sleeper footings are provided since without such a bearing plate the sleepers would provide even less stable positioning in the ballast bed or laying below grade.

OBJECT OF THE INVENTION

The object of the invention is therefore to create a hollow cast sleeper of the generic kind that provides improved stable positioning on the ballast bed.

SUMMARY OF THE INVENTION

This object is attained according to the invention by an approach in which a lower face of the hollow cast sleeper is designed having at least one recessed, downwardly open cavity, preferably a peripheral annular outer wall bordering the cavity. The peripheral outer wall, which, for example, in the case of a hollow cast sleeper produced from a cast material is formed during the fabrication process in the form of an integrally cast or cast-on ribs, frames, or ridges on a lower face of the sleeper, preferably running along the outer periphery of the sleeper lower face and thus to a certain degree downwardly extending the longitudinal and end-face walls of the hollow cast sleeper. The sleeper can be buried in the subgrade or ballast in a stable position by means of the downwardly projecting frame-like outer wall bordering the cavity. At the same time, the outer wall of the sleeper lower face ensures deeper insertion to be achieved so that a solid footing is ensured and the sleeper is held in a stable position manner by the circumferential outer wall.

In a preferred embodiment of the invention, provision is made whereby the sleeper lower face is divided up into subcavities by multiple downwardly projecting partitions extending transversely to the longitudinal axis of the sleeper within the frame-like outer wall. Here again, the partitions are designed in the form of ribs or ridges that are integrally cast or cast on directly on the sleeper lower face during fabrication of the hollow cast sleeper. As a result, multiple recessed cavities are first of all created in the peripheral annular outer wall, which cavities are able to bite into the subgrade or ballast to achieve secure retention of the hollow cast sleepers, and, secondly, segmented seats are also created for preferably elastic or semi-elastic plates or bearing plates serving as the sleeper footing. These can be advantageously provided with different elasticities and/or rigidities, and can be attached, for example, by adhesive bonding, vulcanizing, or fastening with bolts or screws to the planar sleeper lower face.

These individual, segmented plates or sleeper footings in the subcavities enable an improved stable positioning to be achieved for the hollow cast sleeper since irregularities in the contact area between the sleeper lower face and the ballast in the track bed are leveled out.

The outer wall enclosing the outer edges of the plates protects the connection areas between the plates and the sleeper lower face from being peeled off by the ballast gravel.

The plates or bearing plates here can be produced out of materials that have elastic, plastic (e.g. by EVA plates that are comparable to the deformations of the ballast in wooden sleepers, i.e. the ballast gravel impresses itself into the footing by plastic flow), sound-deadening, insulating properties, or a combination of these properties.

The use of plates having different physical and/or mechanical material properties enables the transverse or longitudinal displaceability and bearing property of the hollow cast sleeper to be improved; in particular, the deflection of the footed hollow cast sleeper can be precisely adjusted along the entire length of the sleeper.

In one embodiment of the invention, provision is made whereby only some of the subcavities, preferably the outer subcavities and center subcavity, are fitted with plates. This provides control, for example, over the degree to which the center section of the sleeper bearing is designed to be more compliant while the respective end sections are designed to be more rigid.

In addition, the subdivision of the sleeper lower face into individual, more recessed insertion spaces enables plate segments of smaller area to be used, thereby achieving a more simplified, and thus more cost-effective, fabrication process for the plates.

In another advantageous embodiment of the invention, provision is made whereby at least one downwardly projecting, preferably wedge-shaped anchor element of greater depth than the partitions is provided on the sleeper lower face, this element running transverse to the longitudinal axis of the sleeper. The wedge-shaped anchor element, which during installation of the hollow cast sleeper extends down more deeply into the ballast than the outer wall and/or the cross ridges of the subcavities, and is of variable length as a function of the height of the ballast poured within the track bed, additionally effectively enables the resistance to transverse displacement of the hollow cast sleeper to be increased, thereby achieving an even more improved stable positioning. The anchor element, two of which can be preferably provided spaced apart on the sleeper footing, is advantageously attached to the sleeper lower face in the region of and as a replacement for the partitions running transverse to the longitudinal axis of the sleeper, for example, bolted on, or integrally cast on as part of the casting process for fabricating the hollow cast sleeper.

BRIEF DESCRIPTION OF THE DRAWING

Additional features and details of the invention are described in the claims and in the following description of the embodiments of the subject matter of the invention. Therein:

SPECIFIC DESCRIPTION

Figure 1:
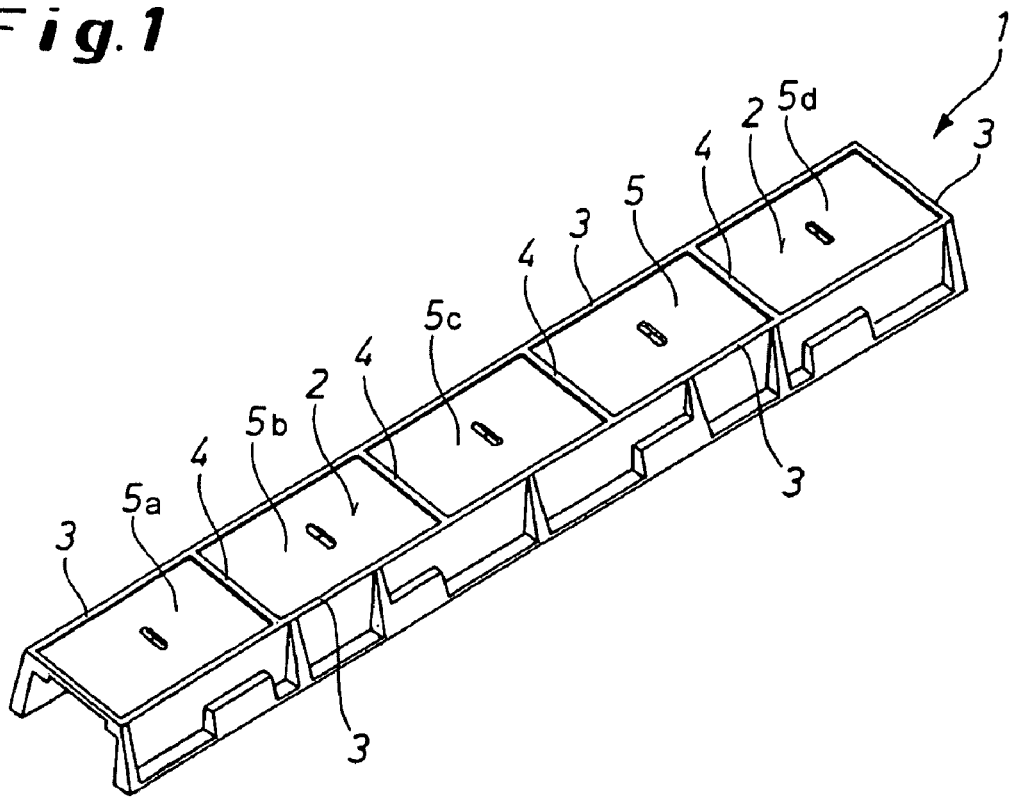
FIG. 1 shows a hollow cast sleeper as seen from below and having subcavities formed on the floor side.
Figure 2:
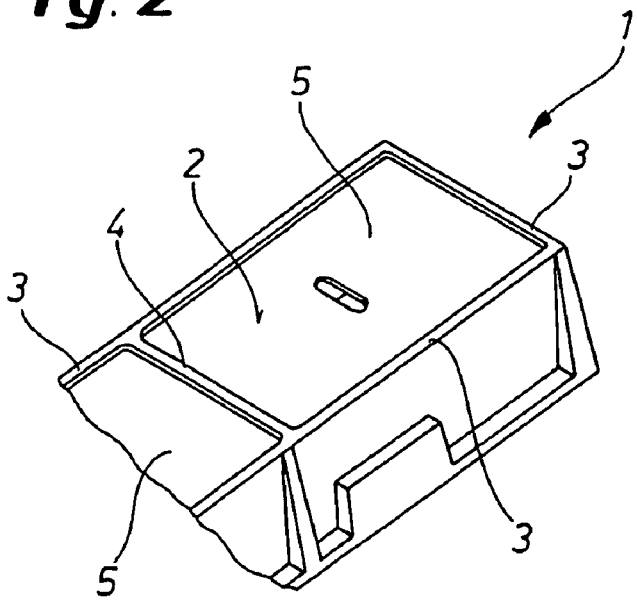
FIG. 2 is a detail view of the hollow cast sleeper of FIG. 1 in enlarged scale, as seen from below.

An upwardly open hollow cast sleeper 1 shown in FIGS. 1 through 4, hereafter referred to as a hollow cast sleeper, is sufficiently familiar per se and is fabricated, for example, from a metal plate folded into a U-section, or, for example, cast from spheroidal cast iron. The sleeper is used in the construction of railroad track systems to create the track bed composed of transversely extending sleepers and rails around switches, and is held in place by its sleeper lower face 2 and sleeper side walls within the ballast bed.

The interior of the hollow cast sleeper 1 accommodates the moving operating parts (not shown here) for moving the switch blades and their closing means ensuring the respective blade end positions, and/or fastening elements for cable crossings or feed-through bushings.

A peripheral annular ridge is integrally molded onto the sleeper lower face 2, the ridge running along the outer periphery of the sleeper lower face 2, thereby forming an outer wall 3 enclosing the otherwise smooth sleeper lower face 2.

In addition, the sleeper lower face 2 in the embodiment is subdivided by a total of four partitions 4 running transversely to the longitudinal axis of the sleeper, thereby in combination with the peripheral annular outer wall 3 creating five separated subcavities 5, 5*a* through 5*d*.

Figure 3:
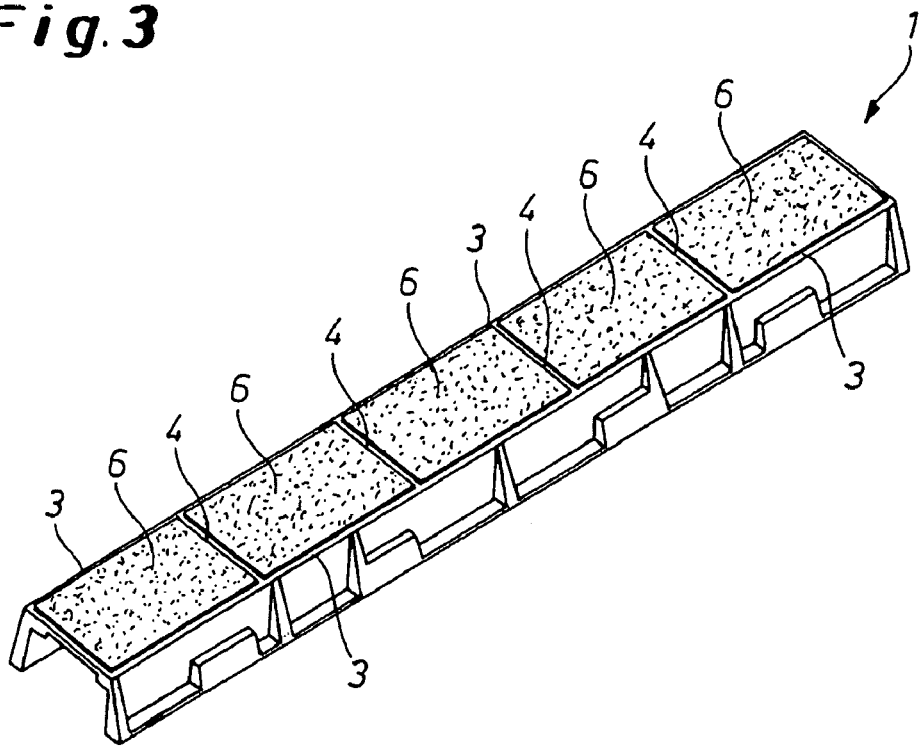
FIG. 3 is a view like FIG. 1, but having plates fitted in the subcavities to create a footing of the lower face of the hollow cast sleeper.

Elastic plates 6 serving as bearing elements to provide the sleeper footing are inserted into the thus-separated subcavities 5, 5*a* through 5*d*, and are attached to the smooth-surfaced sleeper lower face 2 (see FIG. 3). The plates 6 enable an improved stable positioning to be achieved for the hollow cast sleeper 1, so that level variations at the contact area between the track ballast and the sleeper lower face can be compensated out by provision of plates 6 with different coefficients of elasticity or variations in thickness and material. The stable positioning is additionally enhanced by the interfit created by the gaps or transitions between the individual plates 6, lower face, and the ballast gravel.

Due to the circumferential outer wall 3 on the sleeper lower face 2, the free outer edges of the plates 6 are protected from damage, while the glued or vulcanized connection points between the plates 6 and the sleeper footing 2 are protected from being peeled off by ballast gravel.

Figure 4:
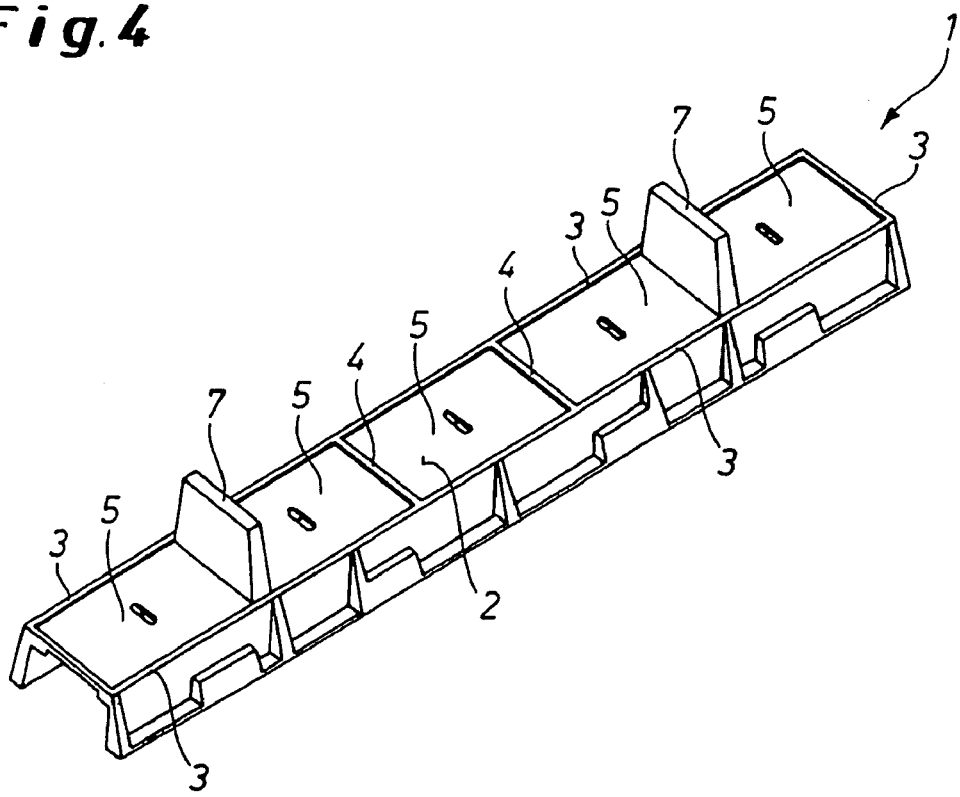
FIG. 4 is a view like FIG. 1, having wedge-shaped anchor elements on the sleeper lower face.

Also revealed in FIG. 4 is that two wedge-shaped anchor elements 7 are integrally molded onto the sleeper lower face 2 on two of the partitions 4. During installation of the hollow cast sleeper 1 in the track bed, the anchor elements 7 embed deeply into the ballast, thereby increasing both the resistance to transverse displacement and the stable positioning of hollow cast sleeper 1.

The invention claimed is:

1. A hollow cast sleeper for actuating elements of switch blades, movable frogs, or cable crossings in track and switch sections, the sleeper comprising an upwardly open hollow cast sleeper profile with a planar sleeper lower face engageable in a track bed, having at least one recessed downwardly open cavity, and having a peripheral, annular and downwardly projecting wall or frame that borders the cavity; and an elastic or semielastic plate acting as a sleeper footing and fitting in the cavity.

2. The hollow cast sleeper according to claim 1, wherein the sleeper lower face is divided into subcavities by multiple partitions disposed transverse to the longitudinal axis of the sleeper lower face within the outer wall or frame and projecting downward, the elastic or semielastic plate being subdivided into a plurality of subplates each fitting in a respective one of the cavities.

3. The hollow cast sleeper according to claim 2, wherein at least two of the plates are provided in each subcavity.

4. The hollow cast sleeper according to claim 2, wherein the subcavities include outer subcavities and a center subcavity that are footed with plates.

5. The hollow cast sleeper according to claim 2, wherein the subplates have different elasticities or rigidities.

6. The hollow cast sleeper according to claim 1, further comprising at least one downwardly projecting and wedge shaped anchor element on the sleeper lower face, of greater depth than the partitions, and running transverse to the longitudinal axis of the sleeper.

* * * * *